United States Patent [19]

Gould

[11] Patent Number: 4,953,302

[45] Date of Patent: Sep. 4, 1990

[54] INTELLIGENT ARCHERY SIGHTING DEVICE

[76] Inventor: Russell P. Gould, P.O. Box 262, Youngstown, Pa. 15696

[21] Appl. No.: 414,378

[22] Filed: Sep. 29, 1989

[51] Int. Cl.[5] ..... F41G 1/46

[52] U.S. Cl. ..... 33/265; 124/87

[58] Field of Search ..... 33/265; 124/87; 356/21

[56] References Cited

U.S. PATENT DOCUMENTS

| | | | |
|---|---|---|---|
| 4,178,693 | 12/1979 | Smith | 33/265 |
| 4,325,190 | 4/1982 | Duerst | 33/265 |
| 4,400,887 | 8/1983 | Mason | 33/265 |
| 4,495,705 | 1/1985 | Kowalski et al. | 33/265 |
| 4,555,856 | 12/1985 | Brown | 33/265 |
| 4,646,444 | 2/1987 | Cary | 33/265 |
| 4,689,887 | 9/1987 | Colvin | 33/265 |
| 4,711,036 | 12/1987 | Morris | 33/265 |
| 4,796,364 | 1/1989 | Amacker | 33/265 |

*Primary Examiner*—William A. Cuchlinski, Jr.
*Assistant Examiner*—Daniel G. DePumpo

[57] ABSTRACT

An archery sight which incorporates an optical distance-measuring device, automatic selection and illumination of the appropriate sight for the distance so measured, and a mechanism to correct for the lesser effect of gravity on the trajectory of the arrow when the target is elevated or depressed with respect to the archer.

7 Claims, 2 Drawing Sheets

INTELLIGENT ARCHERY SIGHTING DEVICE

BACKGROUND OF THE INVENTION

The major drawback of the bow as a hunting weapon is the rainbow-like trajectory of the arrow, requiring accurate distance estimation, particularly at hunting distances. For example, at a distance of 35 yards, a range estimation error of as few as two or three yards can cause a complete miss on a deer-size target, or worse yet, a leg hit. To further complicate matters, a downhill shot, for example one from an elevated tree stand, causes the arrow to fly higher than would be the case in a horizontal shot at the same distance. The same applies to an uphill shot. Skilled bowhunters develop their range-estimation ability through dedicated practice in field conditions, some shooting "instinctively", i.e. without the use of sights or even conscious range-estimation.

Hand-held range-finding instruments are available and present one solution to the problem, but are awkward to use and require extra movement at a time when any movement is undesirable. Crude range estimation devices are available, relying on spaced stadia wires subtending a set angle, which brackets an "average" deer's chest at certain specified distances, but these are not widely used owing to wide variations in body size within and between species. Neither aid corrects for differences in elevation between the target and the archer.

More sophisticated bow-mounted aids are known in prior art. These fall into two main classes: the first comprises sights incorporating optical range-finders which measure the line-of-sight distance but not the angle of inclination or declination to the target; the second class relies on measurement of the angle of declination from an elevated shooting position but not the line-of-sight distance to the target.

Aids of this first type include U.S. Pat. No. 3,136,697 dated Dec. 29, 1964, to D. S. White, claiming an optical range-finder based on a dual spaced mirror device and coupled sighting element; U.S. Pat. No. 2,788,701, dated Apr. 16, 1957, to G. G. Browning, claiming the use of a multi-mirror device; U.S. Pat. No. 4,555,856, dated Dec. 3, 1985, to D. E. Brown, claiming a third adjusting compensating mirror and cam-coupled sight pin; U.S. Pat. No. 4,646,444, dated Mar. 3, 1987, to J. W. Carey, claiming a self-indicating planar/parabolic mirror combination; and U.S. Pat. No. 4,178,693 to G. D. Smith, claiming a two-mirror, split image bowsight incorporating a cam-controlled alignment mechanism. All of these devices are accurate only when the shot is approximately level, and where one or more sight components is customized to the specific shooter, bow, and projectile. For example, Smith's cam and Brown's programmed slide must be customized by highly sophisticated mathematical modelling techniques or by trial and error. Cary's parabolic mirror is provided with means of adjustment relying on the deflection of a flexible, variable thickness mirror. Cary's device, does not have precise horizontal aiming point providing suitable alignment with a particular spot on a nondescript target such as a deer.

The second class of aids includes U.S. Pat. No. 4,120,096 dated October 1978, to Keller, claiming a pivoted sight whose position relative to the sight picture is appropriately elevated as the bow is tilted from the horizontal; U.S. Pat. No. 4,796,364, dated Jan. 10, 1989, to J. A. Amacker, claiming a dual sight comprising a pendulum sight for shooting from an elevated position and a multi-pin sight for use on level ground, each of which can be secured out of the archer's line-of-sight when not in use; U.S. Pat. No. 4,711,036, dated Dec. 8, 1987, to E. Morris claiming two versions of a pendulum-actuated sight; U.S. Pat. No. 4,325,190, dated Apr. 20, 1982 to T. Duerst, claiming a plurality of sights selectively illuminated accordig to the angle of declination of the bow via an electronic circuit incorporating a plurality of switches; and U.S. Pat. No. 4,400,887, dated Aug. 30, 1983 to J. D. Mason, claiming a plurality of sights and a means for selectively causing one pin to be readily distinguishable from the others according to the angle of declination of the bow, via a pendulum-mounted colored lens positioned to selectively interrupt multiple fiber-optic cables. None of these devices serves as a range-finding aid on level or upwardly sloping ground, nor do they function properly where the elevation of the archer relative to the target is unknown (for example where the elevated stand is situated above sloping ground) or where the archer is significantly above or below the restricted height range for which the sight is calibrated. Furthermore, except for the pre-calibrated multi-pin sights of Duerst and Mason, all of these aids provide the same sight correction for all bow/shooter/projectile combinations. In practice, the vast majority of bowhunters shoot and hope for the best, resulting in a higher incidence of poor hits and lost game than would be the case if an accurate range-finding sight were used. Indeed, increasing controversy over the humaneness of the bow as a hunting weapon in the hands of the average hunter mandates the development of such a device.

The present invention is a sight which not only allows the accurate estimation of range, but also indicates which sight pin to use, taking into account deviations from the horizontal. (Bowsights typically have multiple pins, each set for a different distance.) The device measures the distance and angle to the target, indicating the appropriate pin by means of a light source within each pin. Thus, the sight is both error-proof (no room for error in pin selection) and fail-safe (i.e. the sight can be used as a conventional bowsight if the range-finding mechanism becomes inoperable). The range-finding mechanism is operated by the bow hand, allowing the hunter to draw, estimate, aim, and release in one fast, fluid movement. The lighted pin feature facilitates sighting in low light conditions. Finally, the sight is designed to attach to the standard bushings provided by all bow manufacturers, allowing easy installation without special tools.

SUMMARY OF THE INVENTION

The present invention is an intelligent archery sighting device which indicates to the archer which of several integral preset sight pins to use in a given situation, by measuring the distance and vertical angle to the target, and automatically selecting the appropriate pin or pins (if the corrected distance falls between two preset pin distances).

The device comprises an adjustable multiple pin-type sight; a manually operated optical distance-measuring system incorporating a vertically split screen; a pendulum device to measure the angle of inclination or declination to the target; means for selectively illuminating the pins, governed by the measured distance and the angle of inclination or declination to the target; and a housing which contains and protects all the components, and is provided with a means by which the entire device can be attached to a bow.

The archer operates the device by sighting the target object through a vertically split screen, turning a focus knob with a finger of the bow hand until the two halves of the target object are aligned in the split viewing screen, and then aligning the point of aim with the lit pin (or between two lit pins, if more than one are illuminated), and releasing the arrow.

The three species of the present invention described herein are distinguished by the means of governing the selective illumination of the appropriate sight pin(s) according to the position of moving elements in the optical distance measuring device and in the pendulum. The first means is mechanical electrical contact, selectively delivering power to individual light sources for each pin. The second means is the selective transmission of light rays from a source through fiber-optic cables and moving optical elements. The third means is electronic circuitry which accepts as input an electric signal indicating the position of said moving elements and selectively switches power to individual sight pin light sources.

BRIEF DESCRIPTION OF THE DRAWING

Other objects and advantages of the invention will become more apparent from the specification taken in conjunction with the accompanying drawings, in which.

DETAILED DESCRIPTION OF THE INVENTION

Figure 1:
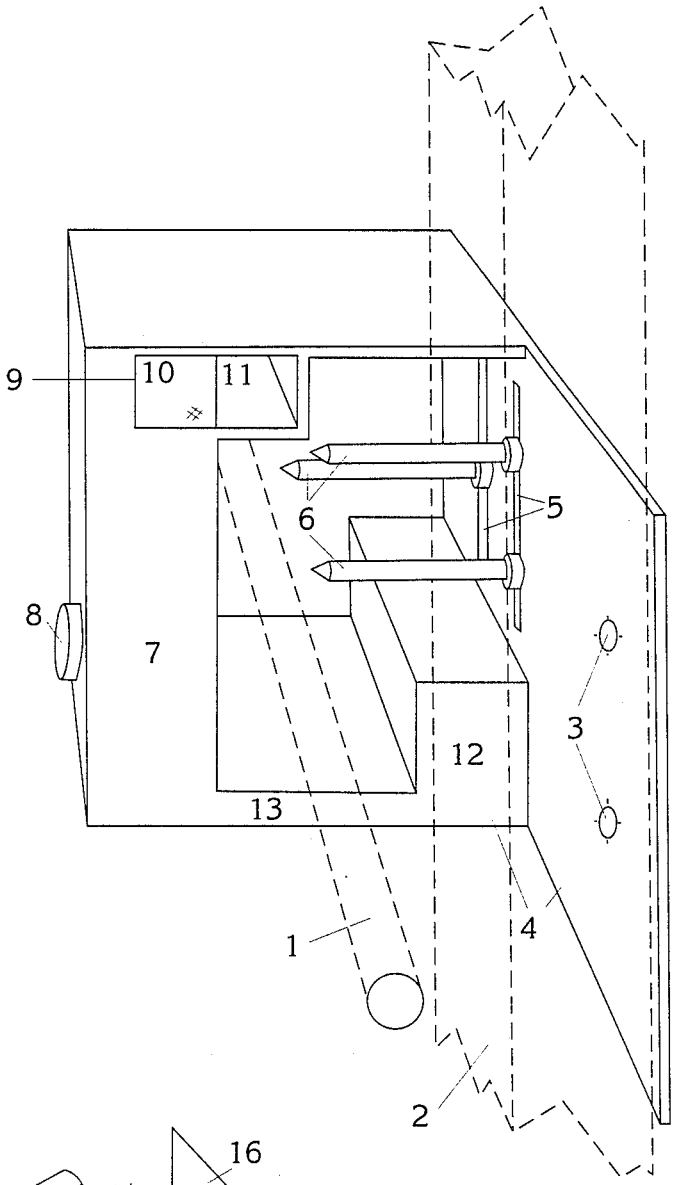
FIG. 1 is a perspective view of the invention attached to the handle of the bow, showing the housing, the split viewing screen, and the multiple-pin sight.

The drawing shown in FIG. 1 depicts the invention and its relationship to the arrow 1 and to the bow 2 to which the invention is attached by means of screws passing through holes 3 in the housing 4, which is also provided with vertical slots 5 to allow the insertion and adjustment of the sight pins 6. Said housing contains a first chamber 7 to house the elements of the distance-measuring device, including the focusing wheel 8 and the vertically split viewing screen 9. The left half 10 of said screen contains a prism (not shown) which provides a view of the target obtained via a mirror (not shown) through a window (not shown) at the lower forward edge of said first chamber. The right half 11 of said screen allows an unobstructed view of the target through a viewing tunnel. A second chamber 12 contains the pendulum device and the means for governing the illumination of the sight pins. A third chamber 13 encloses a rotating shaft (not shown) which connects the focusing wheel 8 to the governing device housed in said second chamber.

Figure 2:
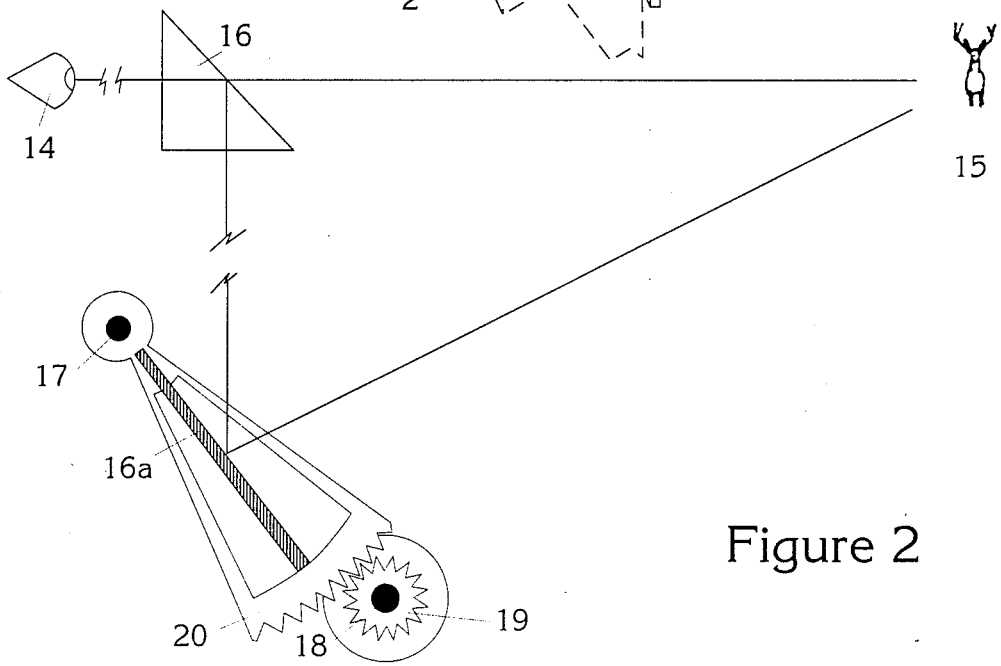
FIG. 2 is a schematic of the key elements of the distance-measuring system contained within the housing.

FIG. 2 depicts the interrelationship of the key elements of the distance-measuring device which allows the archer 14 to effectively measure the distance to the target 15 by aligning the two half-images of the target appearing in said split viewing screen by rotating the focusing wheel 8 with the index finger of the bow hand until the half-image of the target appearing in the right prism 16 aligns with the unobstructed half-image of the target appearing in said viewing tunnel adjacent to said prism. Rotating said wheel causes a mirror 16*a* to pivot around a first shaft 17 according to the rotation of a second shaft 18, to which are attached both said focusing wheel and a small gear 19, which in turn meshes with a section of a larger gear 20, which pivots around said first shaft and to which said mirror is immovably attached. It follows that the final aligned position of said mirror, and therefore said second shaft, depends on the distance to the target, owing to the vertical separation of the two views of the target afforded by the invention. A visual reading of the distance to the target, while not necessary to the usefulness of the invention, is provided by numerals (not shown) inscribed on the perimeter of said focusing wheel and a pointer (not shown) attached within said first chamber, so positioned as to be visible through said prism.

Figure 3:
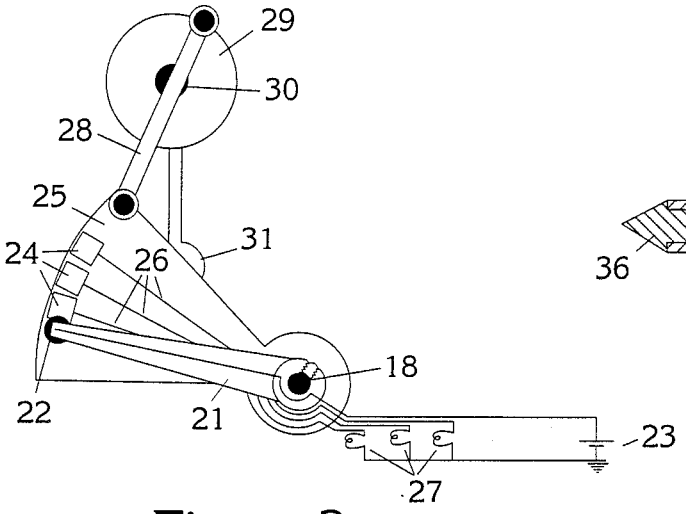
FIG. 3 is a schematic of the key elements of the pendulum device and the electro-mechanical governor of the first species of the invention, all contained within the housing.

FIG. 3 shows the means by which the position of said second shaft 18 in turn and in conjunction with a pendulum device, causes the illumination of a light source within the sight pin(s) appropriate for the distance and angle of inclination or declination to the target. A rotating arm 21 constructed of an insulating material and equipped with a conducting brush 22, is attached to and rotates with said second shaft, conveying electrical power from a battery 23 to said brush. Said brush in turn rotates to contact one (or an adjacent pair) of several conducting segments 24 affixed to the periphery of a carrier 25 constructed of an insulating material, but provided with individual conducting channels 26 connecting each of said segments to an electrical circuit containing an equal number of light sources, each corresponding to and contained within individual sight pins. Said arm and segments are located such that said arm selects for illumination the pin (or pin pair) appropriate to the distance at which the distance-measuring device is focussed. Furthermore, said carrier rotates around said second shaft according to the position of a connecting rod 28 pinned to said carrier and to the furthest point on the perimeter of a disc 29, which disc rotates around a third shaft 30 under the influence of a pendulum 31 attached to said disc. When the invention is tilted from the horizontal in the plane of said disc, for example when sighting a target situated at a lower elevation, said pendulum causes said disc to rotate, pushing said carrier downward to an extent determined by the specific dimensions of the various elements of the governing system. Said downward depression causes the appropriate relative shift in the positions of said carrier and said brush, thereby selecting for illumination a pin or pins corresponding to the (lesser) horizontal (as opposed to the actual) distance to the target, ensuring the necessary correction.

Figure 4:
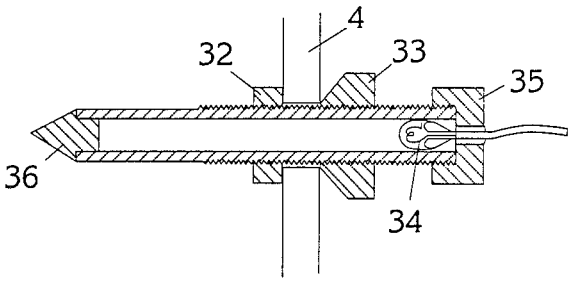
FIG. 4 is a section of one sight pin, suitable for use with the first and third species of the invention, showing the means of adjustment for windage and elevation and the means of illumination.

FIG. 4 is a cross-sectional view of a sight pin locked in position in a slot in said housing 4 by means of a threaded nut 32 and knurled lockring 33. A globe 34 is contained within the hollow pin by means of a threaded cap 35, through which an insulated conducting wire delivers electrical power to said globe. The illumination provided by said globe is visible to the archer through a pointed insert 36 fabricated of a transparent or translucent material.

Figure 5:
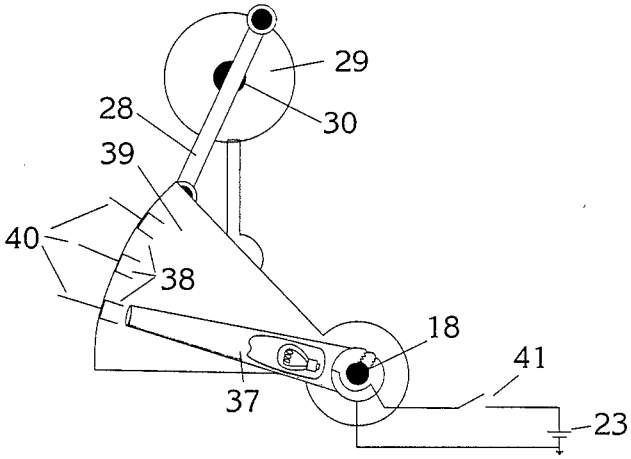
FIG. 5 is a schematic of the key elements of the pendulum device and the fiber-optic governor of the second species of the invention.

FIG. 5 shows the second means by which the adjustment of said distance-measuring system, in conjunction with said pendulum device 31, causes the illumination of the sight pin(s) appropriate for the line-of-sight distance and vertical angle to the target. A rotating light source 37 is adjustably attached to and rotates with said second shaft 18, casting a narrow light beam toward one or an adjacent pair of fiber-optic receptors 38 affixed to the periphery of a carrier 39, each receptor connected individually to a sight pin by means of a separate fiber-optic cable 40. Said light source is connected to a battery 23 via a manually operated switch 41, allowing the archer to activate the device when required. When the sighting device is approximately level, said light source illuminates the preset pin or pin pair appropriate to the distance at which the distance-measuring system is focussed.

Furthermore, said carrier is free to rotate around said second shaft according to the position of a crank affixed to the furthest point on a disc 29, to which said carrier is linked by means of a connecting rod 28. Said disc rotates around a third shaft 30 under the influence of said pendulum. When the sighting device is tilted from the horizontal in the plane of said pendulum, for example when sighting a target situated at a higher elevation, said pendulum causes said disc to rotate, pushing said carrier downward to an extent determined by the specific dimensions of the various elements of the system. This downward depression causes the selection of the sight pin(s) set for a lesser distance than the line-of-sight distance to the target on which the distance-measuring system is focussed. When properly dimensioned, the correcting system causes the selection of the sight pin(s) corresponding approximately to the horizontal component of the line-of-sight distance to the target, ensuring the appropriate correction irrespective of the specific equipment and style of the archer.

Figure 6:
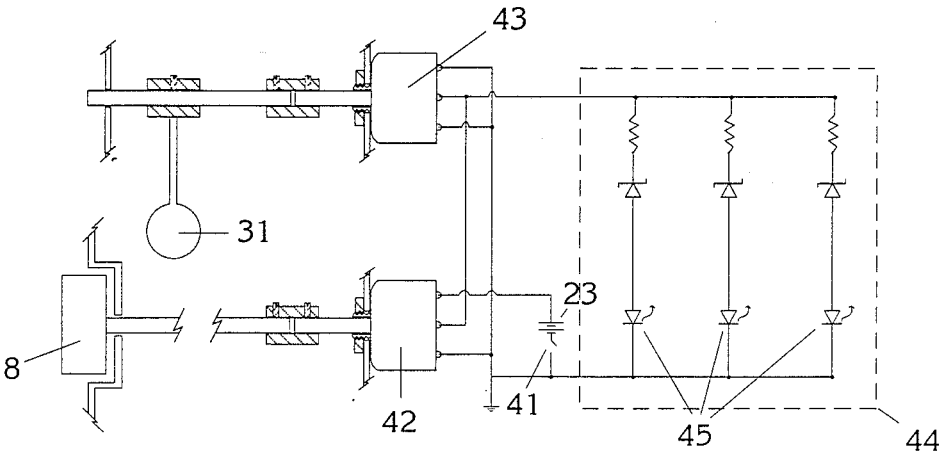
FIG. 6 is a schematic of the key elements of the electronic governor of the third species of the invention.

FIG. 6 shows the third governing means. A first potentiometer 42 is connected to said battery 23 via said manually operated switch 41. Said first potentiometer is actuated by said second shaft 18 such that its voltage output varies from minimum to maximum as said focus knob 8 is manipulated to focus the distance-measuring system from its nearest to furthest effective range. The output voltage of said first potentiometer is applied to a second potentiometer 43 which is actuated by said pendulum 31. Said second potentiometer is wound such that deflections from plumb in either direction of said pendulum cause the output voltage of said first potentiometer to be reduced by a factor equal to the cosine of the angle of deflection of said pendulum. This correction ensures that the final output voltage corresponds to the horizontal component of the line-of-sight distance to the target, and this reduced voltage output is applied to a standard electronic power-indicating circuit 44 such as that commonly found in stereo equipment. Said circuit incorporates a multiplicity of LEDs 45 which illuminate according to the voltage applied to said circuit. When appropriately configured, said circuit causes the illumination of the pin designated for a distance corresponding approximately to the horizontal component of the line-of-sight distance to a target in focus, and simultaneously, all lesser pins if any. The archer uses the greatest lit pin, i.e. that pin with the greatest designated distance.

It is thus seen from the preceeding description that the various elements of the present invention function together as an intelligent sighting device which not only allows the archer to obtain an estimate of the line-of-sight distance to a target, but also provides a highly visible indication of which of several preset sight pins will provide the proper correction for the trajectory of the arrow, automatically compensating for deviations in the angle of the shot from the horizontal. The mathematical principle upon which this correction is based is universal to combinations of shooting style and equipment, allowing economical mass-production of the device.

The specific disclosure of the present invention described above represents three specific embodiments thereof; however, variations are possible, for example the omission of the pendulum compensating device, or the use of color-coding in place of selective illumination to indicate the appropriate sight, and these variations are included in the spirit and scope of the appended claims.

I claim:

1. A bow-mounted archery sighting device for aiding an archer in correctly aiming at a target situated at a distance and at an elevation relative to the archer, said archery sighting device comprising:

i. multiple sights adjustable for windage and elevation, each such sight provided with a means of individual identification, ii. a manually operated optical distance-measuring system which indicates the distance to said target by providing for the controlled alignment of two views from differing angles of the same target, iii. pendulum means responsive to the angle of inclination or declination of the bow in the vertical plane of the bow, iv. sight-indicating means controlling the selective identification of one or two adjacent sights, said sight-indicating means connected to and responsive to said distance-measuring system, v. correcting means for compensating said sight-indicating means according to deflections of said pendulum means, vi. housing means mounting said distance-measuring system said pendulum means sight-indicating means, and correcting means; the bow and said sights are adjustably affixed to said housing means.

2. An archery sighting device as in claim 1 in which said distance-measuring system includes a focusing wheel, a rotating mirror, and a viewing screen providing two separate images of the same target from differing angles, one of said images being adjustable relative to the other, via said rotating mirror whose rotation is controlled by said focusing wheel, the periphery of which said focussing wheel is coded and calibrated to specific distances, and is located such that said coding is visible in said viewing screen said focusing wheel is rotated until said adjustable image is aligned with the other image.

3. First species of an archery sighting device as in claim 1 in which said sight-indicating means comprises a movable electrical contact which, according to the adjustment of the aligning mechanism of the distance-measuring system, makes electrical contact with one or two adjacent conducting segments affixed to a movable carrier, each segment separately connected to an electrical circuit conveying power to an electric light source positioned to illuminate an individual sight.

4. Second species of an archery sighting device as in claim 1 in which said sight-indicating means comprises a movable light source emitting a narrow light beam which, according to the adjustment of the alignment mechanism of the distance-measuring system, impinges on one or two adjacent fiber-optic receptors mounted on a movable carrier, each receptor separately connected to a fiber-optic filament conveying illumination to an individual sight.

5. An archery sighting device as in claims 3 or 4, in which said correcting means comprises a mechanical means; said mechanical means comprising a connecting rod between said movable carrier and a crank driven by said pendulum means, said mechanical means corrects the relative positions of said movable carrier and said electrical contact according to the deflection of said pendulum means, thereby causing the selection of the sights corresponding approximately to the horizontal component of the line-of-sight distance determined by the distance-measuring system.

6. Third species of an archery sighting device as in claim 1 in which said sight-indicating means comprises an electronic sensor, comprising a potentiometer, activated by the alignment mechanism of the distance-measuring system, and connected to an electronic circuit selectively conveying power to one or more electric light sources, each positioned to illuminate an individual sight.

7. An archery sighting device as in claim 6 in which said correcting means comprises a second electronic sensor; said second electronic sensor comprising a potentiometer activated by the deflection of said pendulum means and connected to said electronic circuit such that the sights selected correspond approximately to the horizontal component of the line of sight distance determined by the distance measuring system.

* * * * *